US005160763A

United States Patent [19]

Mims et al.

[11] Patent Number: 5,160,763

[45] Date of Patent: Nov. 3, 1992

[54] GLUE APPLICATOR APPARATUS AND METHOD

[75] Inventors: John D. Mims, Bradford; Thomas M. Porat, Concord, both of N.H.

[73] Assignee: Crathern Engineering Co., Inc., Contoocook, N.H.

[21] Appl. No.: 751,724

[22] Filed: Aug. 29, 1991

[51] Int. Cl.[5] ..... B05C 1/02; B05C 1/12; B05D 1/28

[52] U.S. Cl. ..... 427/207.1; 118/211; 118/245; 118/261; 156/291; 156/578; 427/286; 427/428

[58] Field of Search ..... 118/245, 261, 211; 427/207.1, 286, 288, 428; 156/291, 578; 493/337

[56] References Cited

U.S. PATENT DOCUMENTS

| | | | |
|---|---|---|---|
| 716,434 | 12/1902 | Kneisly | 118/245 |
| 1,932,989 | 10/1933 | Rider | 427/207.1 |
| 2,480,786 | 8/1949 | Steinhilber | 427/207.1 |
| 2,642,032 | 6/1953 | Osgood | 118/245 |
| 2,746,879 | 5/1956 | Sieb | 156/578 |
| 3,957,423 | 5/1976 | Mueller | 118/245 |

*Primary Examiner*—Michael G. Wityshyn
*Attorney, Agent, or Firm*—Schiller & Kusmer

[57] ABSTRACT

This invention involves a system for minimizing the formation of glue drops on picks used to separate a sheet from the surface of a glue applicator drum from which a coating of adhesive is applied to the sheet. Spreader means are provided to wipe from the upstream surface of the drum at least a major portion of the adhesive that lies in the path of each pick.

10 Claims, 1 Drawing Sheet

GLUE APPLICATOR APPARATUS AND METHOD

This invention relates to apparatus for and method of minimizing glue build-up on sheet material passing through glue-applicator equipment and on other equipment subsequently used to process the glue-bearing sheet material.

A number of problems have plagued the continuous application of adhesive to large areas on one or more sides of a web or sheet of sheet material such as paper, as in the case-making industry and the like. For example, in case-making, liquid glue is typically pumped from a glue supply to a glue dispensing roll mounted adjacent a stainless steel applicator roll or drum, the glue being applied to the surface of the drum as from a reservoir formed above the nip of the two rolls. The glue is applied to a moving sheet of the paper as by the rotating drum, and the glue-bearing paper is then separated or peeled from the drum, typically by a group of "picks". The picks are usually small pieces of relatively soft metal, such as brass, that have chisel-pointed ends directed toward and in approximate sliding contact with the surface of the drum along a line parallel to the axis of rotation of the drum. Essentially, as the surface of the applicator roll or drum rotates toward the chisel end of each pick, that end plows out a circumferential line in the layer of glue on the surface of the applicator roll while lifting the paper from that surface. The glue thus scraped from the roll tends to build up on the pick between operations on successive sheets, forming drops. Such glue drops are often transferred from the picks to the leading edge of a subsequent sheet of paper as the latter travels across the pick, depositing the drops as discrete mounds on the paper. Further transfer of that glued sheet to yet other equipment, such as conveyor belts, other rolls, vacuum conveyors and the like, may result in an undesirable transfer and build-up of those glue drops onto that other equipment, smearing the product and rendering it unacceptable, or interfering with the operation of the equipment.

A principal object of the present invention is to overcome this problem inherent in applicator roll type gluers and specifically to obviate or minimize the formation of such glue drops.

The invention accordingly comprises the several steps and the relation of one or more of such steps with respect to each of the others, and the apparatus embodying features of construction, combinations of elements, and arrangement of parts which are adapted to effect such steps, all as exemplified in the following detailed disclosure, and the scope of the invention will be indicated in the claims.

For a fuller understanding of the nature and objects of the invention, reference should be had to the following detailed description taken in connection with the accompanying drawings, wherein like numerals denote like parts, and wherein.

To effect the foregoing and other objects, the present invention includes apparatus for and method of minimizing the formation of such glue drops by removing from the surface of the drum at least a major portion of the adhesive that lies in the path of each pick. To this end, the apparatus of the present invention comprises means for applying a coating of adhesive to a moving sheet from a layer of that adhesive on an applicator drum, a plurality of picks axially positioned along the drum closely adjacent a downstream portion of the drum surface for separating adhesive-coated sheet from the drum surface, and means positioned adjacent upstream portions of the drum surface for removing from the latter at least a major portion of the adhesive layer lying in the path of each of the picks. The method of the present invention involves coating an adhesive onto a moving sheet from an applicator drum, separating the coated sheet from the surface of the drum using a plurality of picks axially positioned along the drum closely adjacent a downstream portion of the drum surface, and removing from upstream portions of the drum surface at least a major portion of the adhesive that lies in the path of each said pick.

Figure 1:
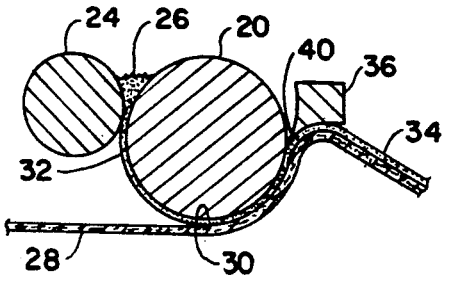
Fig. 1 PRIOR ART
FIG. 1 is a schematic cross-sectional diagram of a prior art coating apparatus.

Referring now to FIG. 1, there will be seen prior art apparatus for coating a moving sheet, which apparatus comprises applicator roll or drum 20 for applying adhesive to a side of a moving sheet of material such as paper. The cylindrical surface of drum 20 is typically formed of polished stainless steel although other materials, of course, can be used. Glue applicator roll 24 is mounted immediately adjacent drum 20, the axis of rotation of roll 24 being parallel to that of drum 20. Means, not shown, are provided for driving drum 20 in rotation, for example, counterclockwise as shown in the drawing, and for driving roll 24 in counterrotation, for example, clockwise as shown in the drawing. Because the surfaces of drum 20 and roll 24 are spaced apart by only a very minute distance, it will be seen that the nip of the drum and the roll constitute a reservoir 26 for liquid adhesive that is pumped thereto by means also not shown.

Means (not shown) are provided for moving sheet 28 of material, such as paper, into tangential contact with the surface of drum 20 at some location or station 30, such as the bottom of drum 20. It will be appreciated that as drum 20 rotates, a thin layer 32 of adhesive will be applied to the surface of the drum by contact between the drum surface with the adhesive at reservoir 26. As is well known, that layer will be spread, at least in part, as an adhesive coating 34 onto the surface of paper sheet 28 when the latter contacts drum 20. For purposes of exposition herein, it will be understood that the term "downstream" as applied to the drum surface refers to one or more stations adjacent the drum surface at points after the paper has contacted the drum surface. Similarly, the term "upstream" is intended to refer to one or more stations adjacent the drum surface at points before the paper has contacted the drum surface.

Because of the typically viscous nature of adhesive coating 34, there is a strong tendency for the paper sheet to remain adhered to roll 20. Thus, typically, the prior art has employed a plurality of picks 36, positioned downstream from the tangential point of contact between paper sheet 28 and roll 20, for separating paper sheet 28 and roll 20. Picks 36 typically are made of a metal, such as brass or the like, softer than the surface of drum 20 so as to minimize scratching the latter. Each pick typically includes a flat wedge or chisel shaped end 40. Means (not shown) are provided for mounting the picks so that ends 40 are positioned in at least very close adjacency, typically in sliding contact, to the downstream surface of drum 20, the ends of the picks being separated from one another but distributed at a series of axial positions along a line parallel to the axis of rotation of drum 20. The width of pick ends 40 usually is quite small, typically being about 0.5 cm or narrower. Thus, as the drum rotates, it carries coated sheet 28 into contact with that line of pick ends 40 which wedge between the sheet and the drum surface, peeling the sheet from the latter. It will be seen that because of the close adjacency of pick ends 40 to the surface of drum 20, the picks essentially will plow out lines, each equal to the width of the corresponding pick end 40, in the layer of adhesive left on the drum surface after separation of the sheet from the latter.

Figure 2:
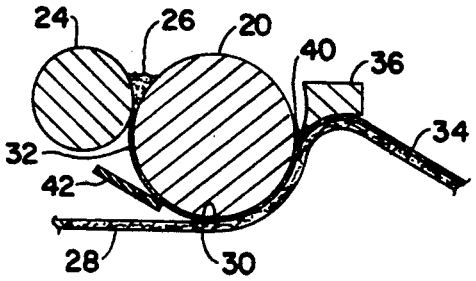
FIG. 2 is a schematic cross-sectional diagram of coating apparatus for carrying out the process of the present invention.
Figure 3:
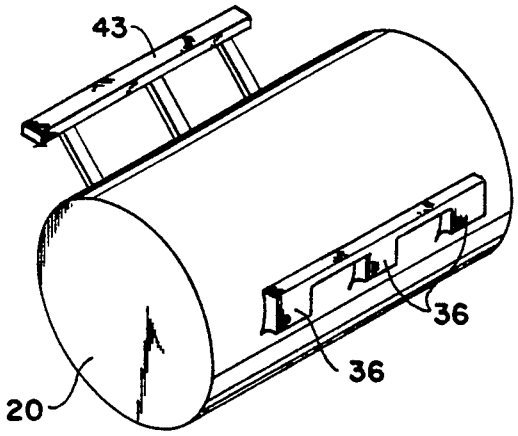
FIG. 3 is an isometric view of the downstream side of the coating drum of FIG. 2 showing the placement of picks.
Figure 4:
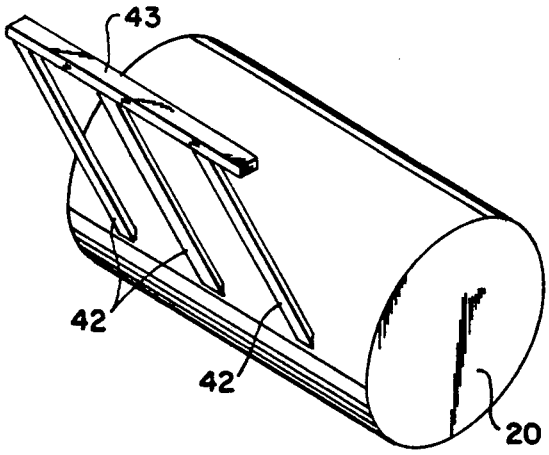
FIG. 4 is an isometric view of the upstream side of the coating drum of FIG. 2 showing the placement of spreaders.

It will be seen in FIG. 2, that the apparatus of the present invention also includes means, in the form of a plurality of scrapers or spreaders 42, preferably in like number to that of picks 36, positioned upstream from the tangential point of contact between paper sheet 28 and roll 20. Spreaders 42 preferably are simply elongated flat strips with squared ends, and are made typically of metal such as brass or the like, softer than the surface of drum 20, but may be formed of polymers such as polytetrafluorethylene or the like. Means 43 are provided for mounting the spreaders so that at least a portion thereof is positioned preferably in contact, but always at least in very close adjacency (i.e., at a distance less than the thickness of the adhesive layer), with the upstream surface of drum 20. Spreaders 42 are separated from one another and distributed at the same series of axial positions along a line parallel to the axis of rotation of drum 20 as the axial positions of the picks. The long axes of the spreaders typically are disposed substantially normal to the axis of rotation of the applicator drum, although they may be canted at an angle up to 7° or 8° from the normal if desired. The width of the portion of each spreader in contact with the drum, measured along the axial line of the drum, should not be less than that of the corresponding pick, and preferably is a small increment wider. As in the prior art, means (not shown) are provided for mounting the picks in appropriate locations.

As the drum rotates, the contact or close proximity between spreaders 42 and the surface of drum 20 will wipe or squeegee the adhesive layer 32 on the upstream surface of the drum, forcing the adhesive to flow out onto each side of the spreaders. This serves to form corresponding lines relatively clear of or having thin films of adhesive on the surface of the drum in the path of each corresponding pick end 40. Thus, the path plowed by the picks after separation of the sheet from the latter will contain little, if any, adhesive and the tendency to form glue drops will be considerably minimized.

Since certain changes may be made in the above-described system without departing from the scope of the invention involved, it is intended that all matter contained in the above description or shown in the accompanying drawing shall be interpreted in an illustrative and not in a limiting sense. For example, while the invention is primarily described for use with discrete sheets of material, it is equally applicable to the processing of continuous webs of material.

What is claimed is:

1. In apparatus for applying a coating of adhesive from an applicator drum to a moving sheet, and including a plurality of picks axially positioned along said drum in contact with a downstream portion of the drum surface for separating a coated sheet from the surface of said drum, the improvement comprising means positioned adjacent upstream portions of said drum surface for removing from said drum surface at least a major portion of said adhesive that lies in the path of each said pick.

2. Apparatus comprising means for applying a coating of adhesive to a moving sheet from a layer of said adhesive on an applicator drum;

a plurality of picks axially positioned along said drum closely adjacent a downstream portion of the surface of said drum, for separating coated sheet from the drum surface; and means positioned adjacent upstream portions of said drum surface for removing from the latter at least a major portion of the adhesive layer lying in the path of each of said picks.

3. Apparatus as set forth in claim 2 wherein said means for removing comprises a plurality of spreaders corresponding in number to said plurality of picks.

4. Apparatus as set forth in claim 3 wherein each of said spreaders is positioned axially along said drum in a location corresponding to the axial position of a corresponding one of said picks.

5. Apparatus as set forth in claim 3 wherein each of said spreaders is formed as a relatively flat, strip at least in close adjacency to one of said upstream portions of said drum surface.

6. Apparatus as set forth in claim 5 wherein each of said spreaders is formed of metal.

7. Apparatus as set forth in claim 5 wherein each of said spreaders is formed of polymeric material.

8. Apparatus as set forth in claim 3 wherein each of said spreaders is formed as a relatively flat strip in sliding contact with one of said upstream portions of said drum surface.

9. In a method of coating a moving sheet with a liquid adhesive from an applicator drum and including the step of separating a coated sheet from the surface of said drum using a plurality of picks axially positioned along said drum in close adjacency to a downstream portion of the drum surface, the improvement comprising the step of removing from upstream portions of said drum surface at least a major portion of said adhesive that lies in the path of each said pick.

10. In a method as set forth in claim 9 wherein said step of removing comprises squeegeeing said adhesive from strips on said drum surface corresponding to the axial positions of said picks.

* * * * *

UNITED STATES PATENT AND TRADEMARK OFFICE

CERTIFICATE OF CORRECTION

PATENT NO. : 5,160,763

DATED : November 3, 1992

INVENTOR(S) : John D. Mims and Thomas M. Porat

It is certified that error appears in the above-identified patent and that said Letters Patent is hereby corrected as shown below:

Claim 5, column 4, line 38, after "flat" delete -- , --.

Signed and Sealed this

Fifth Day of October, 1993

*Attest:*

*Attesting Officer*

BRUCE LEHMAN

*Commissioner of Patents and Trademarks*